US006681776B2

(12) United States Patent
Ogunro et al.

(10) Patent No.: US 6,681,776 B2
(45) Date of Patent: Jan. 27, 2004

(54) MECHANIZED HAIR WRAPPING APPARATUS

(76) Inventors: E. Olayinka Ogunro, 2727 Bolton Boone, Suite 105, DeSoto, TX (US) 75115; Yiu Kwong Wan, 491-501 Castle Peak Rd., Tsuen Wan, New Territories (HK)

( * ) Notice: Subject to any disclaimer, the term of this patent is extended or adjusted under 35 U.S.C. 154(b) by 0 days.

(21) Appl. No.: 10/117,909

(22) Filed: Apr. 8, 2002

(65) Prior Publication Data

US 2003/0188760 A1 Oct. 9, 2003

(51) Int. Cl.[7] ..... A45D 7/02

(52) U.S. Cl. ..... 132/212; 132/271; 242/422.5; 242/593; 57/10

(58) Field of Search ..... 132/212, 271, 132/273, 56, 210; 242/442, 422.5, 593; 57/3, 4, 5, 10

(56) References Cited

U.S. PATENT DOCUMENTS 4,824,036 A * 4/1989 Buta ..... 242/442
5,671,759 A * 9/1997 Chung et al. ..... 132/271

* cited by examiner

*Primary Examiner*—Kevin Shaver
*Assistant Examiner*—Stephanie L. Willatt
(74) *Attorney, Agent, or Firm*—John A. Thomas

(57) ABSTRACT

An apparatus for wrapping hair strands with string or artificial hair is disclosed. The apparatus has a shell that defines an axle having an opening. The axle rotatably supports a drive wheel, a spool of string and a guide wheel. The drive wheel engages the guide wheel. The string passes from the spool past the guide wheel, which has circumferential notches to engage and play out the string. In practice, the user passes a hair strand through the opening in the axle, fastens the string to a hair strand, energizes the apparatus, and moves it along the length of the hair strand as the string is wrapped about the strand. The apparatus is preferably powered by a small DC motor.

14 Claims, 7 Drawing Sheets

MECHANIZED HAIR WRAPPING APPARATUS

FIELD OF THE INVENTION

This invention relates to hair wrapping apparatus, and more particularly to mechanized hair wrapping apparatus that wraps strands of human hair with decorative string or artificial hair.

BACKGROUND OF THE INVENTION

Hair wrapping and hair braiding is an ancient art. Even today it is usually practiced by hand. Some modem hair styles rely on weaving small braids over the entire scalp and thus require considerable time and labor. The art of wrapping hair strands with string also requires much time and labor.

Hair wrapping is accomplished by combing out strands of hair having diameters typically between a few millimeters to a centimeter. The operator then wraps a length of string along the strand. Usually the string will be brightly colored. The wrap may be a tight coil, or a looser more open wrap. The operator may go down the strand with the string and back up, creating a criss-cross effect. Many variations are possible. It is also possible to wrap strands of artificial hair, which are then braided into the natural hair.

The prior art discloses inventions directed to mechanizing the task of hair wrapping. Prior-art mechanized wrappers have problems with maintaining a smooth wrap along the hair strand. This is caused in turn by uneven playing-out of the string and by movement of the strand relative to the rotational axis of the wrapping device. The latter effect requires the operator to exercise great care in holding the device in the correct position. The present invention solves these problems, while also being easy to manufacture.

SUMMARY OF THE INVENTION

The preferred embodiment of the invention is an apparatus that comprises a circular shell that defines an axle. The axle has a central opening for the passage of a strand of hair to be wrapped.

A reversible DC motor is mounted in a handle attached to the shell. The motor drives a pinion gear about an axis that is perpendicular to the axis of the axle. A drive wheel is rotatably fitted over the axle. The drive wheel has a ring gear engaging the pinion gear. The drive wheel also has one or more axial slots for engaging a guide wheel.

A retaining ring is mounted over the drive wheel and the axle; the retaining ring has a circumferential hole that allows a friction wheel to project through it. A spring urges the friction wheel against the drive wheel. In the preferred embodiment, the friction wheel and spring are mounted in the handle, adjacent to the shell.

A spool for holding string for wrapping hair strands is rotatably fitted over the axle and the retaining ring. The spool can rotate freely about the axle as string is played out from it.

A guide wheel that has one or more axial lugs and a flange is rotatably fitted on the axle and over the spool so that the lugs engage the slots on the drive wheel. The flange of the guide wheel has a plurality of circumferential notches for engaging and playing out the string.

A centralizer is fitted over the shell and over the guide wheel for maintaining a hair strand substantially central within the central opening of the axle. In the preferred embodiment the centralizer further comprises a flexible membrane. The flexible membrane has a central hole for passage of the hair strand through it.

DETAILED DESCRIPTION OF THE INVENTION

Figure 1:
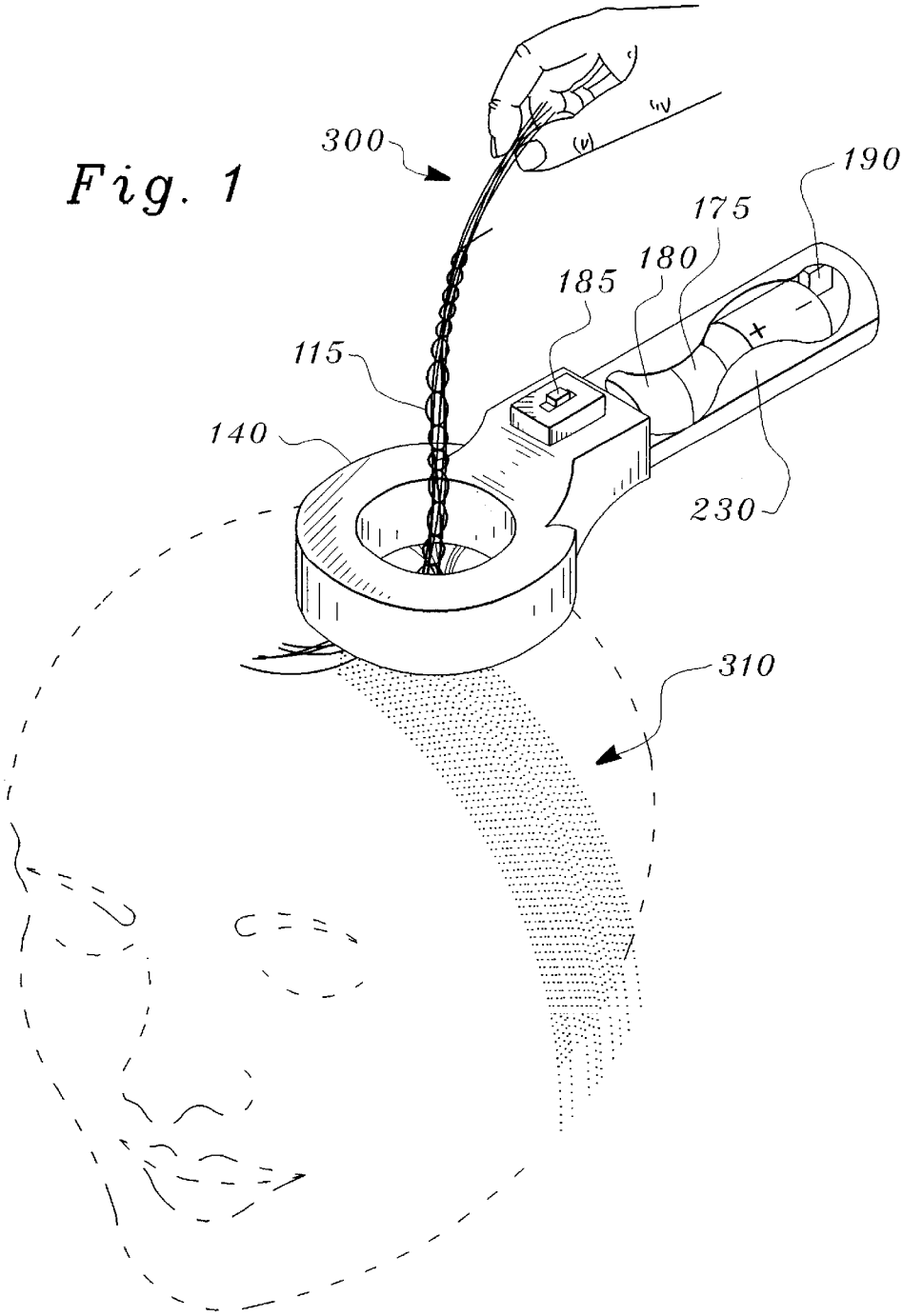
FIG. 1 is a perspective view showing the preferred embodiment in use to wrap a hair strand. A cut-away shows the power source for the motor, in this view, a battery.
Figure 2:
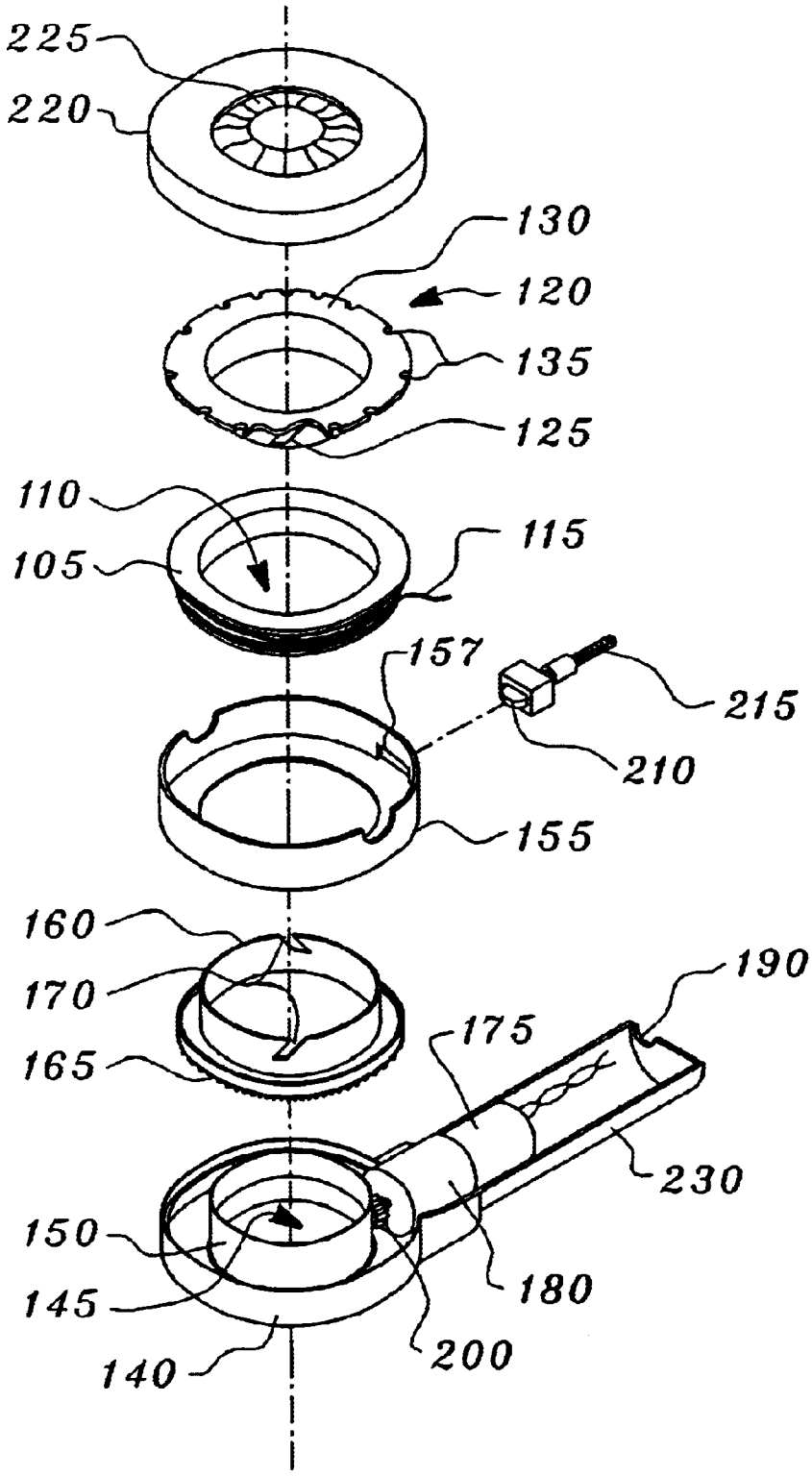
FIG. 2 is an exploded perspective view of the components of the preferred embodiment.

In general, the preferred embodiment is a hand-held device. FIG. 1 shows the preferred embodiment in use to wrap a strand of hair from a human head. FIG. 2 shows an exploded view. A shell (140) defines an axle (150) that has a central opening (145). A handle (230) attached to the shell (140) holds a motor (175) and either a connection (190) for an external power source or a battery (195). A drive wheel (160) fits rotatably over the axle (150). The drive wheel (160) has a ring gear (165) which is driven by a pinion gear (200) attached to the motor (175). The motor (175) preferably is a brushless DC motor having a transmission (180) to reduce the speed of the pinion gear (200) to a practical rate. AC motors could also be used, depending on the external power source.

The drive wheel (160) is held in position in the shell (140) by a retaining ring (155). The retaining ring (155) is preferably removably mounted over the drive wheel (160). As shown in FIG. 2, the retaining ring (155) has a circumferential hole (157) for receiving a friction wheel (210). The friction wheel (210) presses against the rotating drive wheel (160), urged by a spring (215), to steady its rate of rotation and prevent backlash if the drive wheel (160) is stopped.

A spool (105) of string (115) for wrapping fits rotatably over the portion of the drive wheel (160) protruding through the retaining ring (155). A guide wheel (120) then fits through the spool (105) and inside the drive wheel (160). In the preferred embodiment, the guide wheel (120) has axial lugs (125) which engage slots (170) on the drive wheel (160). When the drive wheel (160) is caused to rotate by the engagement of the ring gear (165) and pinion gear (200), the slots (170) and the lugs (125) engage and turn the guide wheel (120).

The purpose of the guide wheel (120) is to play out the string (115) from the spool (105). To this end, the guide wheel (120) has a flange (130); the flange (130) having notches (135) around its circumference for grasping the string (115) and pulling the string (115) off the spool (105).

In the preferred embodiment, a centralizer (220) is provided to maintain the hair strand (300) substantially central within the opening (145) of the axle (150). This position ensures the wrap will be symmetrical about the strand (300). The centralizer (220) may include a flexible membrane (225), as shown in FIG. 2, to accommodate some lateral movement of the hair strand (300) while still maintaining it substantially central. The centralizer (220) is made flexible to allow the user to insert his or her fingers through it to grasp a strand of hair (300) and pull it through the opening (145).

FIG. 1 shows the preferred embodiment in use. A hair strand (300) from the head (310) is selected and a length of the string (115) is tied about the strand (300) close to the head (310). For the purpose of this disclosure the "beginning" of a hair strand is assumed to be close to the head (310), although it would be possible, if inconvenient to begin wrapping at the end of the strand (300) distant from the head (310).

FIG. 1 shows a switch (185) for controlling the motor (175), which may be reversible. In FIG. 1, the cut-away portion of the handle (230) shows a battery (195) supplying power to the motor (175).

Figure 3:
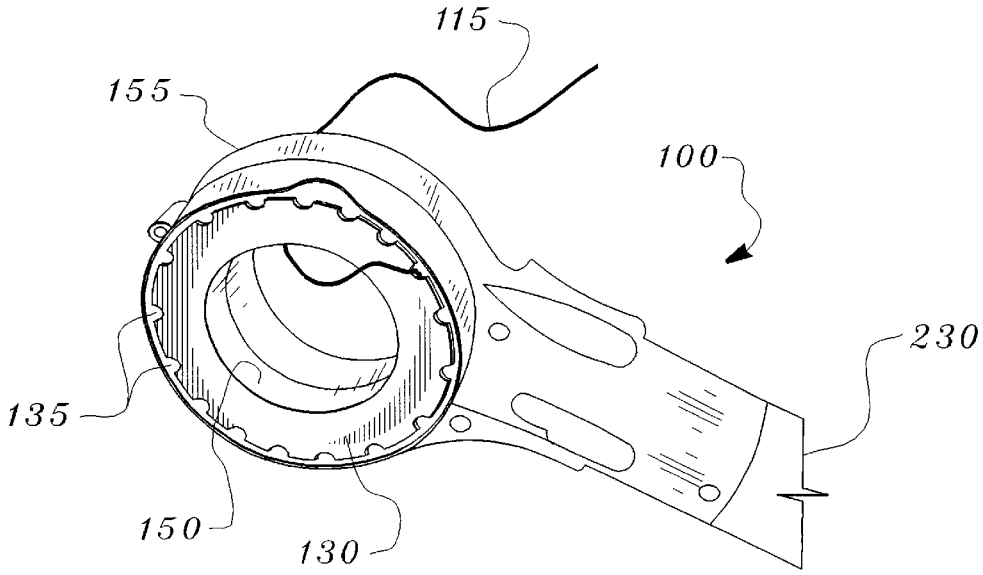
FIG. 3 is a perspective view showing the path of the string from the spool through the axle. The centralizer is removed.

FIG. 3 shows the preferred method. of passing the string (115) from the spool (105) around the circumference of the guide wheel (120), so that the string (115) is engaged and moved by the notches (135) in the circumference of the guide wheel (120). The string (115) is first passed through the axle (150) before being fastened to the hair strand (300).

Figure 4:
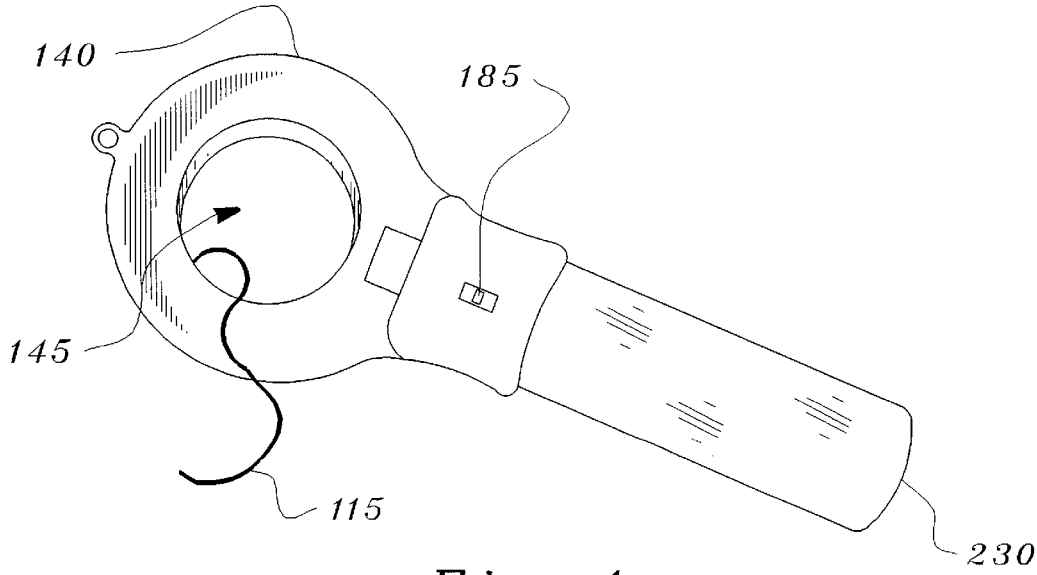
FIG. 4 is a perspective view showing the reverse side of FIG. 3.
Figure 5:
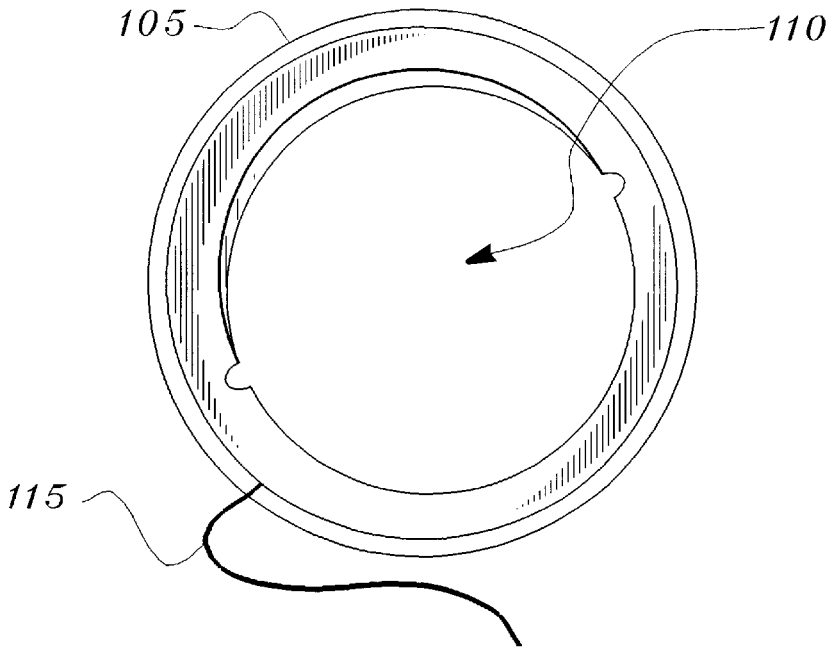
FIG. 5 is a perspective view of the spool.
Figure 6:
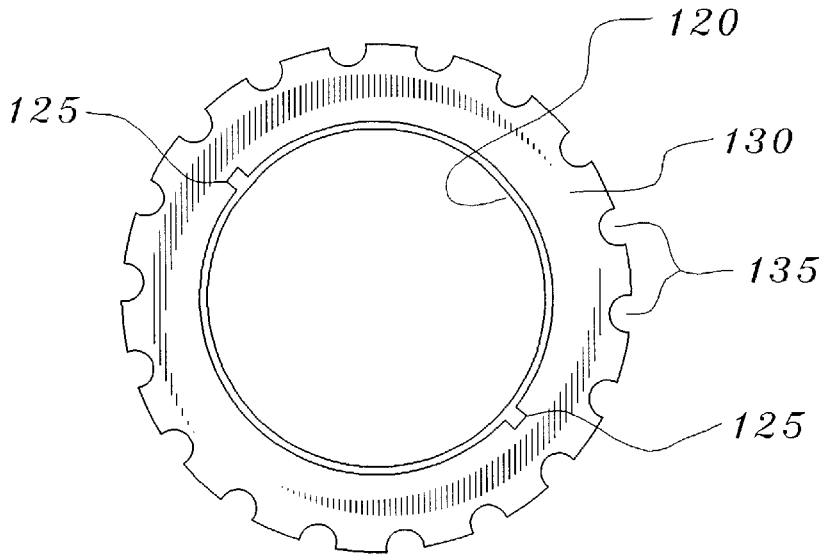
FIG. 6 is a plan view of the guide wheel.
Figure 7:
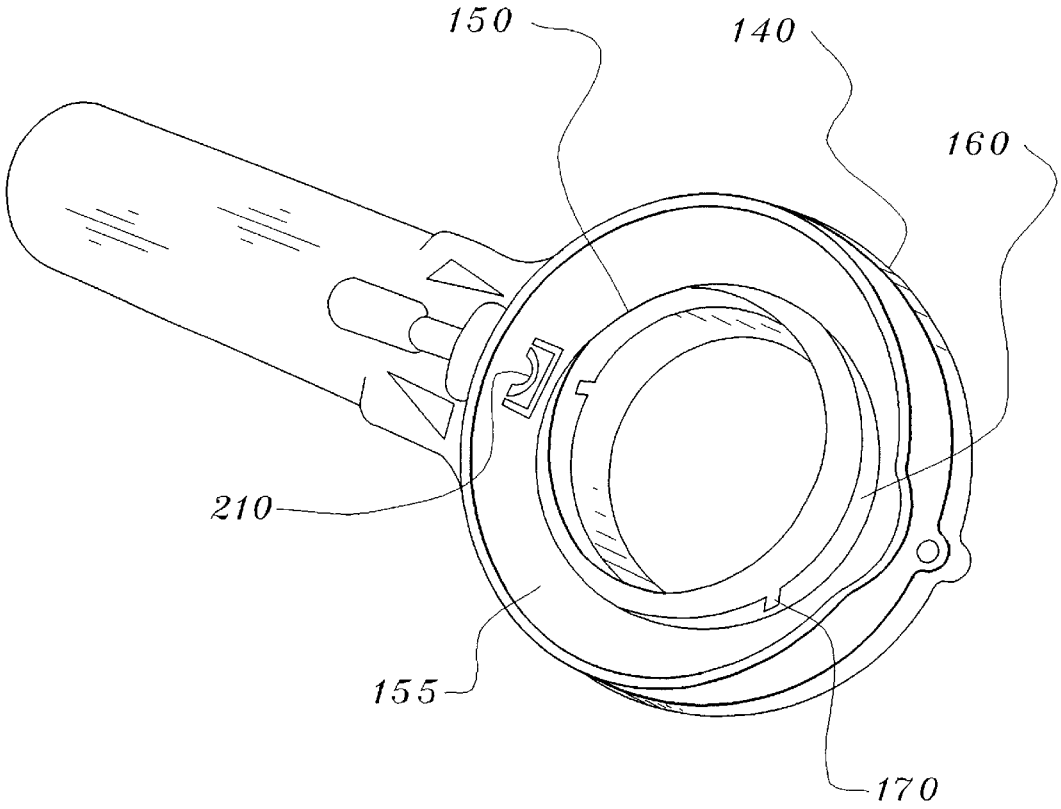
FIG. 7 is a perspective view of the preferred embodiment showing the retaining ring in place over the drive wheel, and a view of the friction wheel.
Figure 8:
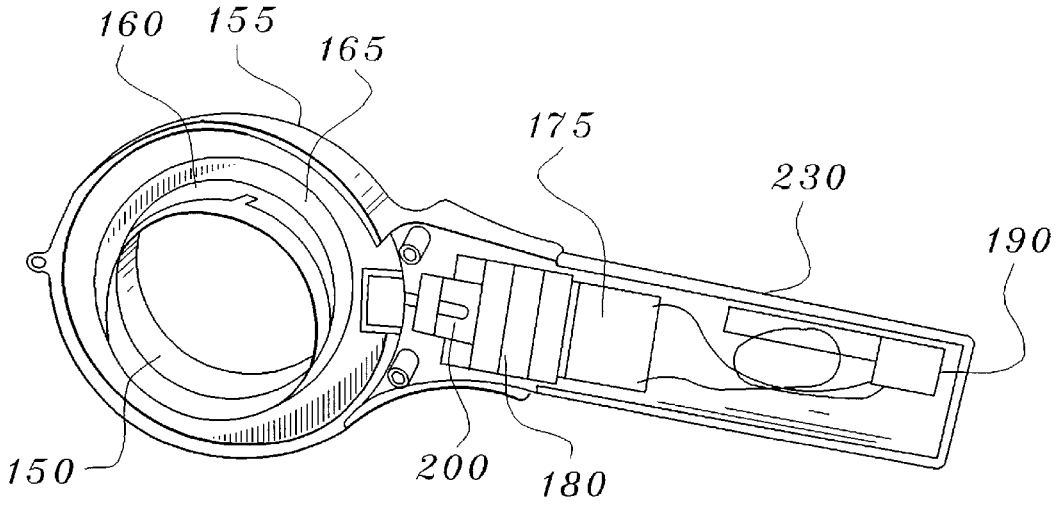
FIG. 8 shows a perspective view of the preferred embodiment with the axle exposed and the motor compartment open.
Figure 9:
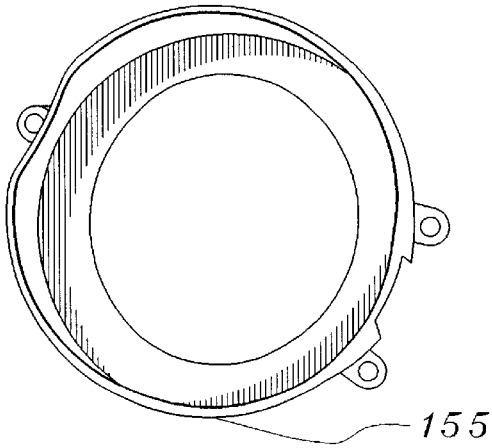
FIG. 9 is a perspective view of the retaining ring.

FIG. 4 shows reverse of the view in FIG. 3, showing the string (115) passing through the opening (145) of the axle (150). FIGS. 5 and 6 show the spool (105) and guide wheel (120), respectively. FIG. 7 shows the the retaining ring (155) in place over the drive wheel, and a view of the friction wheel (210). FIG. 8 is a view with the axle (150) exposed and the cover of the handle (230) removed to show the motor (175), transmission (180) and power source (190). FIG. 9 is a view of the retaining ring (155).

Figure 10:
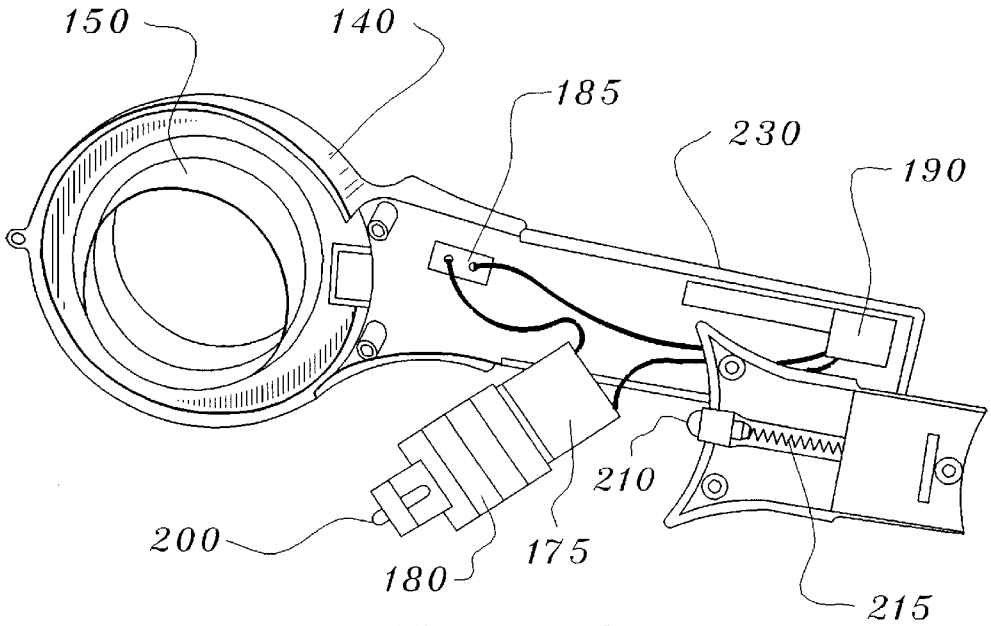
FIG. 10 is a perspective view of preferred embodiment showing the motor and the friction wheel.
Figure 11:
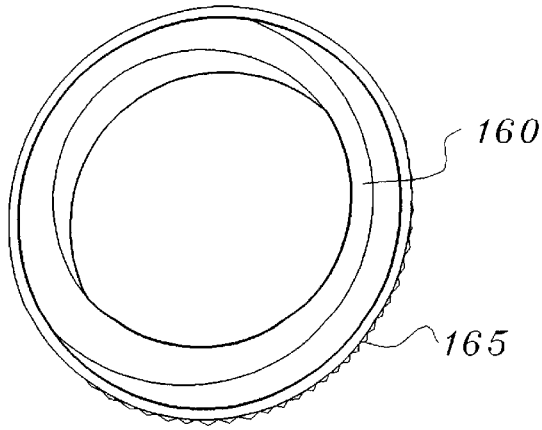
FIG. 11 is a perspective view of the drive wheel.

FIG. 10 shows the shell (140) and handle (230) of the preferred embodiment with the spool (105) and guide wheel (120) removed and the top of the handle (230) removed. Also shown is a portion of the handle (230) that holds the friction wheel (210) and spring (215). FIG. 11 is a view of the ring gear (165).

The wrap is accomplished by energizing the motor, then moving the apparatus up from the beginning position, so that the turning string (115) wraps around the hair strand. The wrap may be a tight coil, or a looser, more open wrap. The operator may go down the strand with the string and back up, creating a criss-cross effect. Many variations are possible. It is also possible to wrap strands of artificial hair, which are then braided into the natural hair.

The need for a mechanically simple yet mechanized hair wrapping apparatus has been attained by the present invention, as described above. Since certain changes could be made in the embodiment of the invention described above without departing from the spirit and scope of the invention, we intend that all matter contained in the foregoing description and drawings shall be interpreted as illustrative and not in a limiting sense. The reader should understand that the following claims are intended to cover all of the generic and specific features of the invention herein described and all statements of the scope of the invention which might be interpreted to fall between these features.

We claim:

1. An apparatus for wrapping hair, comprising:

a circular shell; the shell defining an axle, the axle having a central opening;

a motor; the motor driving a pinion gear;

a drive wheel rotatably fitted over the axle; the drive wheel having a ring gear engaging the pinion gear; the drive wheel further having one or more axial slots;

a spool for holding string; the spool rotatably fitted on the axle; and, a guide wheel; the guide wheel having one or more axial lugs; the guide wheel further having a flange; the flange having a plurality of circumferential notches for engaging and playing out the string; the guide wheel rotatably fitted on the axle and over the spool so that the lugs engage the slots on the drive wheel.

2. The apparatus of claim 1 above, further comprising:

a retaining ring mounted over the drive wheel and the axle; the retaining ring further having a circumferential hole;

a friction wheel disposed to project through the circumferential hole; and, a spring urging the friction wheel against the drive wheel.

3. The apparatus of claim 1 above, further comprising a centralizer fitted over the shell and over the guide wheel for maintaining a hair strand substantially central within the central opening of the axle.

4. The apparatus of claim 1 above, further comprising a handle; the handle connected to the shell; and, the motor disposed within the handle.

5. The apparatus of claim 1 above where the motor is a DC motor.

6. The apparatus of claim 5 above where the motor is powered by one or more batteries.

7. The apparatus of claim 1 above where the motor is powered by a remote power supply.

8. The apparatus of claim 1 above where motor is reversible.

9. The apparatus of claim 3 where the centralizer further comprises a flexible membrane; the flexible membrane having a central hole for passage of a hair strand.

10. An apparatus for wrapping hair, comprising:

a circular shell; the shell defining an axle, the axle having a central opening;

a reversible DC motor; the motor driving a pinion gear;

a drive wheel rotatably fitted over the axle; the drive wheel having a ring gear engaging the pinion gear; the drive wheel further having one or more axial slots;

a retaining ring mounted over the drive wheel and the axle; the retaining ring having a circumferential hole;

a friction wheel disposed to project through the circumferential hole;

a spring urging the friction wheel against the drive wheel;

a spool for holding string; the spool rotatably fitted over the axle and the retaining ring;

a guide wheel; the guide wheel having one or more axial lugs; the guide wheel further having a flange; the flange having a plurality of circumferential notches for engaging and playing out the string; the guide wheel rotatably fitted on the axle and over the spool so that the lugs engage the slots on the drive wheel;

a centralizer fitted over the shell and over the guide wheel for maintaining a hair strand substantially central within the central opening of the axle; the centralizer further comprising a flexible membrane; the flexible membrane having a central hole for passage of the hair strand through the central hole; and, a handle, the handle connected to the shell; the motor disposed within the handle.

11. A method of wrapping hair, using an apparatus comprising:

a circular shell; the shell defining an axle, the axle having a central opening;

a motor; the motor driving a pinion gear;

a drive wheel rotatably fitted over the axle; the drive wheel having a ring gear engaging the pinion gear; the drive wheel further having one or more axial slots;

a spool for holding string; the spool rotatably fitted on the axle; and, a guide wheel; the guide wheel having one or more axial lugs; the guide wheel further having a flange; the flange having a plurality of circumferential notches for engaging and playing out the string; the guide wheel rotatably fitted on the axle and over the spool so that. the lugs engage the slots on the drive wheel; the method comprising the steps of:

selecting a strand of hair to be wrapped;

passing the strand of hair through the axle so that the guide wheel is facing the beginning of the strand of hair;

tying the free end of the string to the strand of hair;

energizing the motor; and, moving the apparatus of claim 1 away from the beginning of the strand of hair so that the string is wrapped around the strand of hair.

12. The method of claim 11 where the apparatus further comprises:

a retaining ring mounted over the drive wheel and the axle; the retaining ring further having a circumferential hole;

a friction wheel disposed to project through the circumferential hole; and, a spring urging the friction wheel against the drive wheel.

13. The method of claim 11 where the apparatus further comprises a centralizer fitted over the shell and over the guide wheel for maintaining a hair strand substantially central within the central opening of the axle.

14. The method of claim 11 where the centralizer further comprises a flexible membrane; the flexible membrane having a central hole for passage of a hair strand.

* * * * *